US007178934B2

(12) United States Patent
McInnis

(10) Patent No.: US 7,178,934 B2
(45) Date of Patent: Feb. 20, 2007

(54) DISPLAY TOOL FOR LIGHT FIXTURE

(75) Inventor: Rodney McInnis, Ottawa (CA)

(73) Assignee: DelphiTech Corporation, Ottawa (CA)

( * ) Notice: Subject to any disclaimer, the term of this patent is extended or adjusted under 35 U.S.C. 154(b) by 77 days.

(21) Appl. No.: 10/990,612

(22) Filed: Nov. 17, 2004

(65) Prior Publication Data

US 2005/0237745 A1 Oct. 27, 2005

(30) Foreign Application Priority Data

Dec. 30, 2003 (CA) ..... 2454501

(51) Int. Cl.
*F21V 33/00* (2006.01)

(52) U.S. Cl. ..... 362/109; 362/120

(58) Field of Classification Search ..... 362/109, 362/120, 119; 15/230.11, 103.5, 103.3; 401/197
See application file for complete search history.

(56) References Cited

U.S. PATENT DOCUMENTS 4,175,300 A * 11/1979 McGlew et al. ..... 15/103.5
6,012,865 A * 1/2000 Scott ..... 401/197
6,454,428 B1 * 9/2002 Bruzon ..... 362/119
6,588,065 B1 * 7/2003 Tucker, III ..... 16/429
6,941,609 B2 * 9/2005 Woodruff et al. ..... 15/230.11
2003/0142489 A1 * 7/2003 Cooper et al. ..... 362/109

* cited by examiner

*Primary Examiner*—Renee Luebke
*Assistant Examiner*—Zahra I. Bennett
(74) *Attorney, Agent, or Firm*—Rissman Jobse, Hendricks & Oliverio

(57) ABSTRACT

A display tool for a light fixture comprising: a pole; a roller, the roller extending angularly from a first end of the pole and roller means being rotatable on an axis angular to the pole; a mounting means for connecting the light fixture to the roller; an actuation means, the actuation means adapted to rotate the roller; and a power source adapted to supply power to the light fixture, whereby an angle of illumination of the light fixture is adjustable by rotation of the pole and the roller.

19 Claims, 3 Drawing Sheets

DISPLAY TOOL FOR LIGHT FIXTURE

FIELD OF THE INVENTION

The present invention relates to tools for positioning objects over a user's head, and in particular to a tool for positioning light fixtures to determine the desired location before installation.

BACKGROUND OF THE INVENTION

Accent and decorative lighting is often used for illuminating the exteriors of homes or buildings. Owners and designers may wish to highlight or draw attention to a particular architectural feature or simply to decorate a pathway, porch or doorway with light. Small lights such as LEDs or halogen lights are often used for these purposes.

A person who intends to install outdoor accent lights on their home for example, would like to be able to test the effect of the light in a particular location before installation rather than just guess that it will look good in that location.

Moreover, the desired position of accent and decorative light fixtures is often high up on a building wall or on a roof soffit. This makes it difficult for a person to test whether the spot chosen for the light will achieve the envisioned illumination as the location is too high up to reach and because there is no power source yet installed for the fixture. Further, even if the light fixture was positioned in an above location, a person far below it would have difficulty manipulating the fixture to shine in different directions. That person would have to climb up a ladder and manually relocate or readjust the angle of the light and then climb down again to see if the light has the correct effect. Much time, energy and frustration is involved in this method as well, the safety of the person wishing to test the position of their lights is at risk.

SUMMARY OF THE INVENTION

It is an object of the present invention to provide a display tool for a light fixture for the purpose of demonstrating how the light fixture will look in a particular location prior to its installation. It is a further object of the invention to facilitate the positioning of the light fixture at various heights and at various angles. It is also an object of the invention to provide power to the light fixture subject of the display tool so that a user may see the effect of the illumination of the light in a particular location.

The present invention includes a height adjustable telescopic pole with a powered light fixture attached to a rotatable cylinder at the top end. The rotatable cylinder is affixed in a perpendicular position to the telescopic pole. The light fixture is positioned such that the light is directed in a perpendicular direction to the rotatable cylinder and is aligned in the same direction as the telescopic pole.

The telescopic pole can be set to various heights in order to position the light fixture vertically at a desired height. The rotatable cylinder can be rotated 360 degrees in the vertical plane by means of a guide string/wire. The telescopic pole may be rotated 360 degrees in the horizontal plane by the user. Thus by rotating the cylinder and by rotating the telescopic pole, the display tool may be adjusted such that a light that is actually on may be set at any desired angle.

The light fixture is powered by a battery pack preferably affixed to the non-adjustable portion of the telescopic pole.

The present invention therefore provides a display tool for a light fixture comprising: a pole; a roller, said roller extending angularly from a first end of said pole and roller means being rotatable on an axis angular to said pole; a mounting means for connecting said light fixture to said roller; an actuation means, said actuation means adapted to rotate said roller; and a power source adapted to supply power to said light fixture, whereby an angle of illumination of said light fixture is adjustable by rotation of said pole and said roller.

BRIEF DESCRIPTION OF THE DRAWINGS

The present invention will be better understood with reference to the drawings, in which.

DETAILED DESCRIPTION OF THE INVENTION

Figure 1:
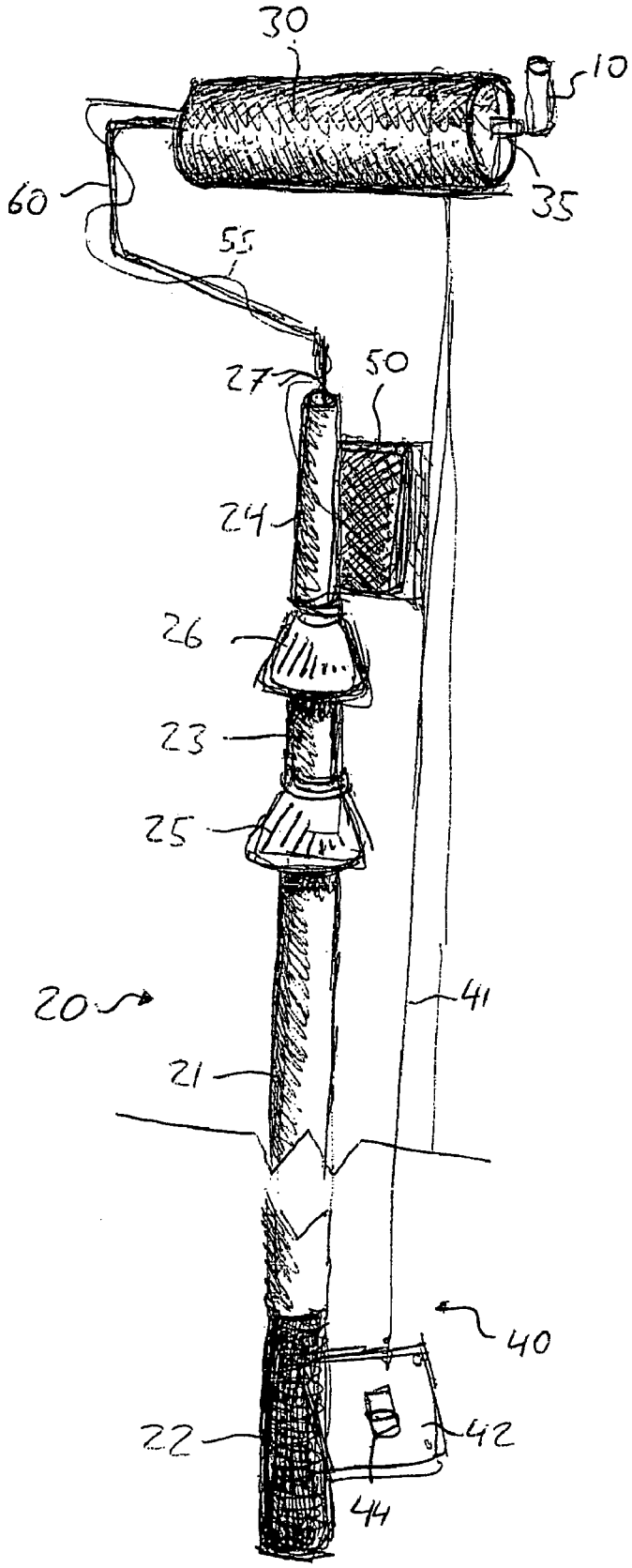
FIG. 1 is a perspective view of the positioning tool of the present invention.

Referring now to the drawings, FIG. 1 shows the preferred embodiment.

FIG. 1 illustrates the components of the display tool for light fixture including a pole, which in the preferred embodiment is an extensible pole 20. One skilled in the art will realize that other poles are possible, including non-extendable poles for certain applications, or poles with any number of telescopic portions.

Extensible pole 20 has three parts in the embodiment of FIG. 1. The first part 21 has a grip 22 for a person to grasp with one hand. The second part, 23 extends outward from the first part telescopically. The third part, 24, extends outwards from the second part telescopically.

Adjustment ring 25 is an annular ring fitted about the extensible end of the first part 21. To allow the second part 23 to slide out from the first part 21, adjustment ring 25 is loosened by turning in one direction (either clockwise or counterclockwise). When the second part 23 is extended the desired distance from the first part 21, adjustment ring 25 may be tightened by turning it the opposite direction to secure the second part 23 into place.

Similarly, adjustment ring 26 is an annular ring fitted about the extensible end of the second part 23. To allow the third part 24 to slide out from the second part 23, adjustment ring 26 is loosened by turning. When the third part 24 is extended the desired distance from the second part 23, adjustment ring 26 may be tightened by turning it the opposite direction to secure the third part 24 into place.

A hook shaped arm 60 is fixedly attached to the non-extensible end 27 of third part 24. This hook shaped arm is bent angularly away from the non-extensible end 27.

Roller 30 is a rotatable cylinder with two capped ends. The roller 30 rotates along its long or horizontal axis. One end of roller 30 is attached to the tip of hook shaped arm 60. The other end has a mounting means 35 for mounting a light fixture 10. In a preferred embodiment roller 30 has a spring embedded between it and hook shaped arm 60 to return roller 30 to a starting position after roller 30 has been rotated.

Mounting means 35 can be adapted to hold a variety of different light fixtures such as halogen lights, LEDs, or incandescent bulbs. LEDs are used in the preferred embodiment.

Wire 55 connects at one end to light fixture 10 and at the other end connects to power source 50. Power source 50 in the preferred embodiment is a battery pack and is located on the third part 24 of extensible pole 20. Wire 55 preferably runs from light fixture 10 through a hole in one end of roller 30, through the interior of roller 30 and out through a hole on the other side of roller 30. Wire 55 is attached or even wound loosely around arm 60 and connects to power source 50. Alternatively, wire 55 may connect directly from power source 50 to mounting means 35.

Figure 2:
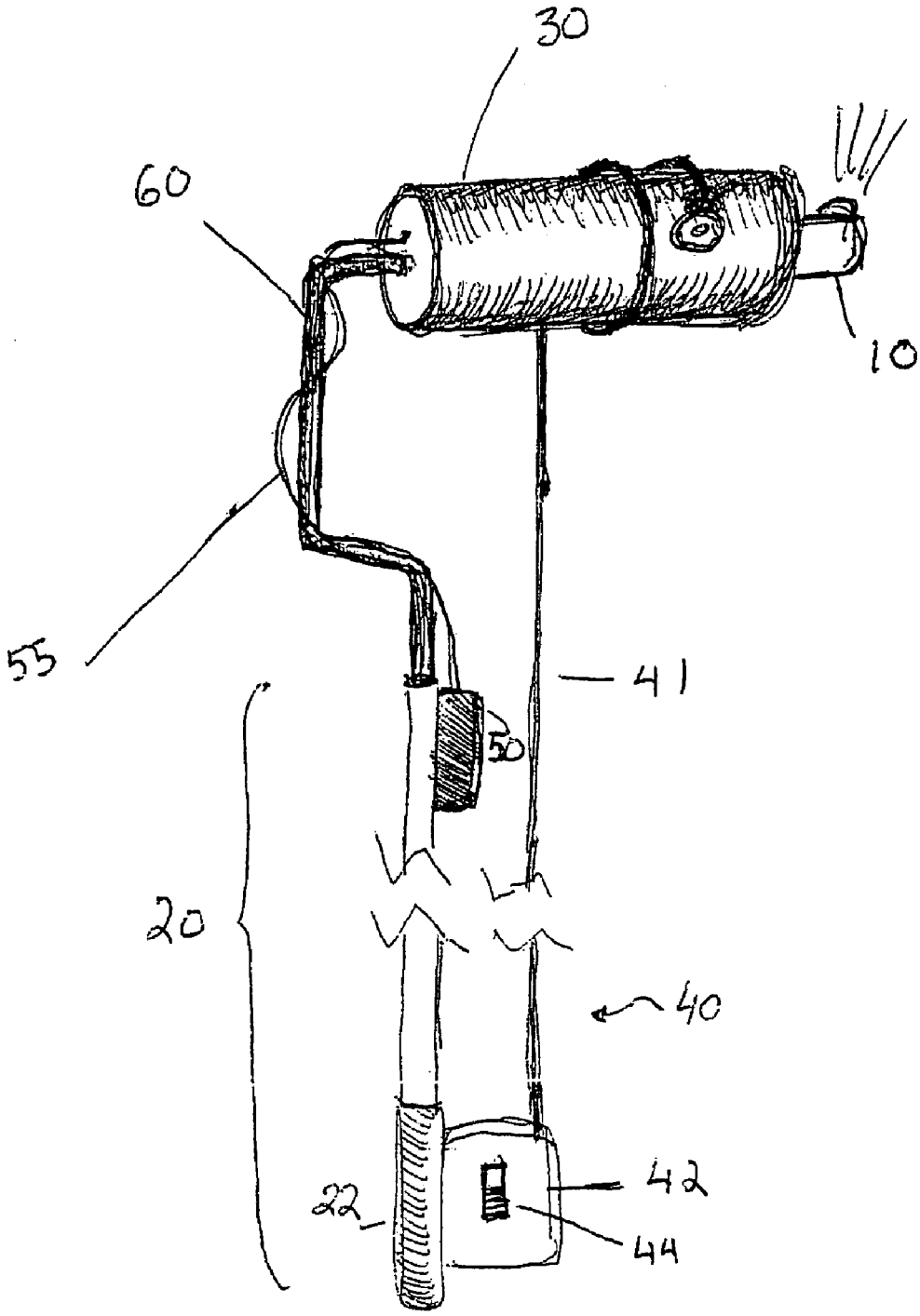
FIG. 2 is a perspective view of the actuation means of the tool of FIG. 1.

Referring now to FIG. 2, an actuation means 40 is used by a person to turn or rotate roller 30. In the preferred embodiment the actuation means 40 comprises a cord 41 having a first end being fixedly attached to roller 30 by a tying it to roller 30. In the preferred embodiment a screw head or a bolt attached to roller 30 is provided to tie the end of the string to roller 30.

To position a light fixture 10, the cord 41 is pulled at its free end, the roller 30 rotates and turns light fixture 10 in up to a 360 degree radius. To right roller 30 to its original position, cord 41 is released and due to the spring in roller 30, roller 30 returns back to its original position.

A person may wish to use a reel 42 situated at grip 22 on the extensible pole 20. The reel 42 pulls or stretches cord 41. A lock mechanism 44 is used to hold or fasten the cord 41 in place once the desired rotation of roller 30 is achieved. This allows the user to have his or her hands free to hold and manoeuver the extensible pole 20 and not have to hold onto the cord end. Upon releasing the lock mechanism 44 and thereby the cord 41 from its locked position, the cord 41 returns to its original position based on the spring in roller 30, likewise returning light fixture 10 to its rest position.

A person skilled in the art will realize that the actuation means may take other forms. For example, roller 30 may have two cords attached to it to, one to rotate the roller in either direction.

Figure 3:
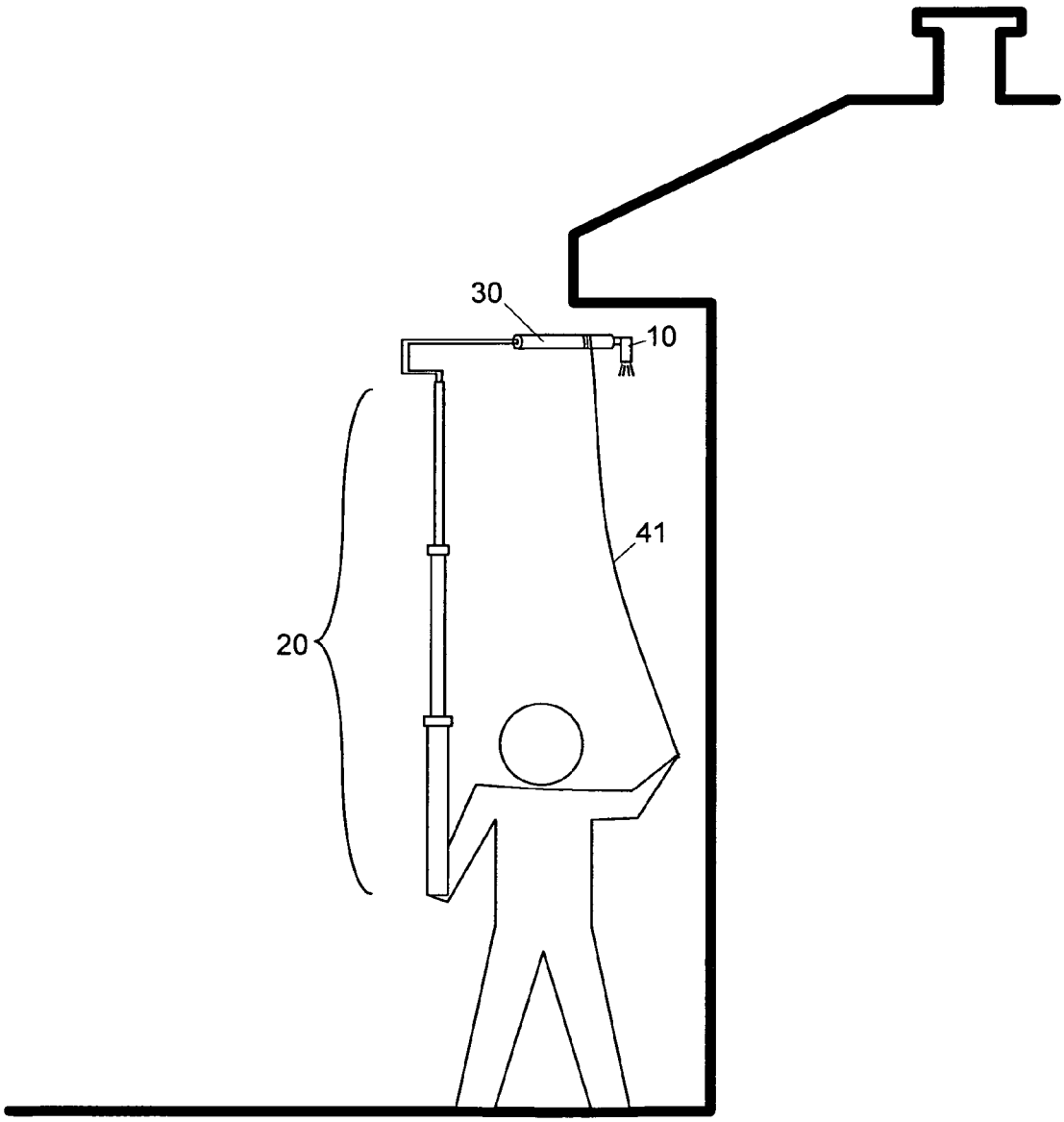
FIG. 3 is an illustration of the present invention in use.

Referring to FIG. 3, a person who pulls on cord 41 with one hand can manipulate light fixture 10 by rotating roller 30. By rotating extensible pole 20 the person can manipulate light fixture 10 up to 360 degrees in the plane perpendicular to extensible pole 20. By rotating roller 30, the person can manipulate light fixture 10 up to 360 degrees in the plane perpendicular to roller 30. The person can also tilt extensible pole 20 angularly. With all of these possibilities of adjustment, the angle of illumination of light fixture 10 is adjustable to any angle by rotation and tilting of extensible pole 20 and by rotation of roller 30.

The versatility of the present invention is only limited by a user's imagination and other configurations would be evident to a skilled person.

The above described embodiments of the present invention are meant to be illustrative of the preferred embodiment of the present invention and are not intended to limit the scope of the present invention. Various modifications, which would be readily apparent to one skilled in the art, are intended to be within the scope of the present invention. The only limitation to the scope of the present invention are set out in the following claims.

The invention claimed is:

1. A display tool for a light fixture comprising:

a pole;

a roller, said roller extending angularly from a first end of said pole and the roller being rotatable on an axis angular to said pole;

a mounting means for connecting said light fixture to said roller;

an actuation means, said actuation means adapted to rotate said roller; and a power source adapted to supply power to said light fixture, whereby an angle of illumination of said light fixture is adjustable by rotation of said pole and said roller, wherein said light fixture is attached substantially perpendicularly to said roller.

2. The display tool of claim 1, wherein said pole is extensible.

3. The display tool of claim 1, wherein said roller is substantially perpendicular to said pole.

4. The display tool of claim 1, wherein said pole and said roller are joined by a connecting arm.

5. The display tool of claim 1, wherein the actuation means comprises a string having a first end being fixedly attached to the roller and a second end positioned about a second end of said pole.

6. The display tool of claim 5, wherein said actuation means further comprises a reel to hold said string at said second end of said pole.

7. The display tool of claim 6, wherein said reel includes a lock for locking said string when said roller has been rotated.

8. The display tool of claim 1, wherein said roller includes a return spring to return said roller to a starting position after said roller has been rotated and then released.

9. The display tool of claim 1, wherein said light fixture comprises a light emitting diode.

10. The display tool of claim 1, wherein said power source is a battery pack.

11. An apparatus, comprising:

a pole having a first end and a second end;

a roller, coupled to the first end of the pole, the roller being rotatable on an axis at an angle with respect to the pole;

an illumination source attached to the roller; and an actuator, coupled to the roller, and operable to rotate the roller about its axis.

12. The apparatus of claim 11, wherein the illumination source is one of: a Light Emitting Diode (LED); a halogen light; and an incandescent light.

13. The apparatus of claim 11, further comprising:

a power supply coupled to the illumination source.

14. The apparatus of claim 11, wherein the actuator comprises:

a string having a first end fixedly attached to the roller.

15. The apparatus of claim 14, wherein:

the string comprises a second end positioned about the second end of the pole.

16. The apparatus of claim 14, wherein the actuator further comprises:

a reel, connected to the pole, to hold the second end of the string.

17. The apparatus of claim 16, wherein the reel further comprises:

a locking mechanism to stop the string from moving.

18. The apparatus of claim 11, further comprising:

a return spring, coupled to the roller, and biased to return the roller to a first position.

19. The apparatus of claim 13, wherein the power supply comprises a battery.

* * * * *